United States Patent [19]

Schneider

[11] Patent Number: 5,045,697

[45] Date of Patent: Sep. 3, 1991

[54] DIRECTLY IMAGE PRINTING OR FORM CYLINDER, AND METHOD OF IMAGING

[75] Inventor: Josef Schneider, Diedorf-Lettenbach, Fed. Rep. of Germany

[73] Assignee: Man Roland Druckmaschinen AG, Offenbach am Main, Fed. Rep. of Germany

[21] Appl. No.: 528,585

[22] Filed: May 24, 1990

[30] Foreign Application Priority Data

Jun. 1, 1989 [DE] Fed. Rep. of Germany ..... 3917844

[51] Int. Cl.[5] ..... G03G 5/16

[52] U.S. Cl. ..... 250/316.1; 219/216; 346/76 PH

[58] Field of Search ..... 250/316.1, 317.1, 318, 250/319; 355/286; 219/216; 346/76 PH

[56] References Cited

U.S. PATENT DOCUMENTS 3,630,732 12/1971 Gravenwezel et al. ..... 250/318
3,655,379 4/1972 Gundlach ..... 250/318

FOREIGN PATENT DOCUMENTS 2734340 2/1978 Fed. Rep. of Germany .
3248178 7/1984 Fed. Rep. of Germany .
3421029 12/1985 Fed. Rep. of Germany .
0046661 2/1987 Japan ..... 346/76 PH

*Primary Examiner*—Bruce C. Anderson
*Attorney, Agent, or Firm*—Frishauf, Holtz, Goodman & Woodward

[57] ABSTRACT

To reduce the energy required upon application of oleophilic or hydrophilic substances, respectively, on a printing or forme cylinder (1, 11) by a thermo transfer process, the cylinder is hollow and made of a radiation transmissive material, such as glass or glass ceramic, and radiation sources (8; 18, 19, 20, 21) are located at the inside thereof, directed, at least to the region of the application of the substances by the thermo transfer process; additional radiation sources may be located ahead of and behind the thermo transfer system (2–6) to preheat the region of thermo transfer, and/or to other circumferential regions to set or burn off or soften the substances, if desired, for subsequent removal and erasing of the information on the cylinder.

20 Claims, 1 Drawing Sheet

DIRECTLY IMAGE PRINTING OR FORM CYLINDER, AND METHOD OF IMAGING

FIELD OF THE INVENTION

The present invention relates to imaging of a plate or form cylinder in a printing machine, and more particularly to imaging a plate or form cylinder for an offset printing machine, using a direct imaging system applying a thermo transfer process.

BACKGROUND

It has previously been proposed, see the German Patent Disclosure Document DE-OS 32 48 178, Schneider, to image a form cylinder by a thermo transfer process. A thermo transfer foil is carried adjacent the cylinder to be imaged, which is coated at the side facing the form cylinder with a thermo or electro-thermosensitive material. A recording head, located at the back side of the film, is selectively, for example digitally energized to melt elementary particles from the thermosensitive film and transfer these particles on the form cylinder, where they will adhere or bond to the surface thereof.

The arrangement appears practicable from a theoretical point of view; in actual practice, however, it has been found that the energy requirements to obtain sufficient transfer of material and adhesion is very high; as described in the patent, the surface of the form cylinder may be aluminum which is an excellent heat conductor, so that heat transferred thereto is rapidly conducted away, placing high energy demands on the recording head.

THE INVENTION

It is an object to improve application of particles on a printing or plate or form cylinder, in which the required energy is substantially reduced with respect to that heretofore necessary.

Briefly, the cylinder surface is so arranged that it is transparent to radiation and, additionally, includes an energy source located within the interior of the cylinder and directing radiation towards the surface thereof, or towards at least a surface portion thereof which is subjected to transfer of information-carrying particles.

The arrangement has the advantage that the energy requirement placed on the recording head is substantially reduced. It permits advantageously to provide energy to the cylinder from the interior thereof. This energy can be applied to the cylinder by preheating the surface which supports the transfer of particles to the surface of the cylinder. Additionally, however, it has the further advantage that the energy supplied from the interior may be used to burn-in the particles on the surface, to cause photochemical bonding of oleophilic image elements and, further, to melt the elements after they have been applied so that the subject matter of the printed image, previously recorded thereon, can be easily erased. Rather than melting, the energy supplied can be sufficient to vaporize, decompose, or burn off the image elements previously transferred thereto, or to any adhesion layer or adhesion particles adhering the image element to the cylinder. Placing the additional energy source into the interior of the form cylinder has the further advantage that the restricted space available at the outer circumference thereof is not interfered with. The thermo transfer unit as such requires some space for effective application of image elements; the additional energy source does not require space at the outer circumference of the cylinder. Thus, sufficient space is available at the outer circumference of the cylinder for engagement thereagainst of inker rollers, damper substance rollers, and of an offset rubber blanket cylinder.

DRAWINGS

FIG. 1 is a highly schematic cross-sectional view through a form cylinder having a radiation source in the interior thereof; and FIG. 2 is a view similar to FIG. 1 with a plurality of radiation sources.

DETAILED DESCRIPTION

Figure 1:
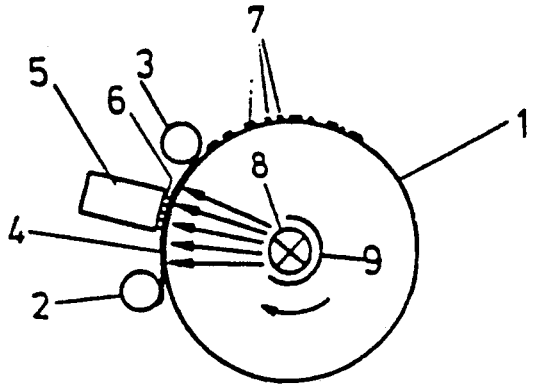

FIG. 1 shows a form cylinder 1 of a rotary offset printing machine. The various associated cylinders and rollers, customarily engaged with the plate or form cylinder, have been omitted from the drawing, for clarity, and may be of any suitable and well known construction.

A thermo transfer unit for direct imaging of the form cylinder is engaged thereagainst. It includes a thermo transfer foil 4, spooled between two reels 2, 3. The side of the thermo transfer foil 4 facing the cylinder carries transfer material; the back side thereof is operatively associated with a point or dot transfer unit 5. The inker supply rollers, damping fluid supply rollers and the rubber blanket cylinder, all of which can be of standard and well known construction, have been omitted from FIG. 1 since they do not form part of the present invention.

The thermo transfer foil 4 has a thermosensitive or electro-thermosensitive coating on the side facing the form cylinder 1. The coating is made of an oleophilic substance, and may, for example, include a waxy material. The thermo transfer foil 4 has a carrier layer facing the recording head 5, which is of good heat conductive material. The form cylinder 1 has a surface which has hydrophilic characteristics.

The recording head 5 preferably includes energy transfer elements located in a matrix, for example to provide transfer of energy under controlled conditions over very small areas, and so arranged that it can provide for energy transfer in a plurality of lines. Energy transfer elements, arranged in lines, are in contact or close to the carrier layer of the thermo transfer foil 4. These elements can be heating elements, pin electrodes, or semiconductor lasers. Digitial information is transmitted to the recording head 5 and the respective energy transfer elements 6 are activated precisely at the time when, at an incremental area of the form cylinder, ink should be accepted thereon upon subsequent inking of the form cylinder. The energy acting on the thermo transfer foil 4, as transmitted by the elements 6, dissolves tiny particles 7 from the coating, having a size corresponding to an image dot. In FIG. 1, these particles 7 are shown greatly enlarged and distorted for clarity. The image particles 7 are deposited on the form cylinder 1, and they solidify at the surface thereof. Due to their oleophilic characteristics, they will accept and transfer ink.

In accordance with the present invention, the form cylinder 1 has a radiation transmissive cylinder wall, and a radiation source 8 in the interior thereof, directing radiation towards the inner cylinder wall. The cylinder wall of FIG. 1 is made of glass or, preferably, of a glass ceramic. The radiation source 8, located in the interior of the cylinder emits radiation which is preferably high in the infrared range. An infrared radiating lamp is suitable. A reflector 9, located at the back side of the lamp, directs the radiation towards a predetermined circumferential sector of the cylinder wall. The deflector directs the radiation, preferably, into that circumferential range on which the thermo transfer unit 5 transfers energy. The radiation from lamp 8 supports and enhances the total radiation, part of which is derived from elements 6. The wall and the coating on the foil 4 are thus so preheated that the elements 6 need supply only so much energy necessary to melt the incremental particles 7. This substantially decreases the time required to transfer images or other graphic representations on the form cylinder 1.

Figure 2:
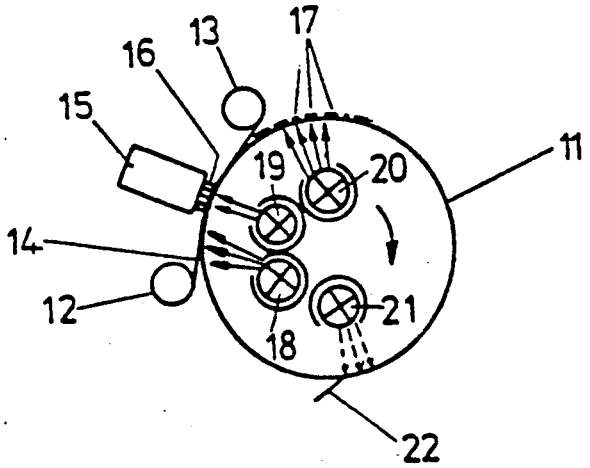

FIG. 2 illustrates, besides the cylinder 7, foil 14, thermo transfer head 15 and spooling reels 12, 13, in addition a plurality of radiation units 18, 19, 20, 21. The thermo transfer unit 15 with its energy transmitting dot or point transmitters 16, reels 12, 13 and foil 14 correspond, and can be identical to the similar structures 2–6 explained in connection with FIG. 1. The cylinder 11 has a radiation transmissive wall or surface.

The first radiation source 18 directs radiation to a circumferential range of the inner wall of the form cylinder 11 which, in the direction of rotation of the cylinder as shown by the arrow therein, is ahead of or leading with respect to the imaging region in which the thermo transfer head 15 is active. This radiation source 18 may transmit infrared or visible light and is used to preheat the cylinder surface.

A second radiation source 19 is directed to the circumferential range of the inner surface of the form cylinder 11 against which the thermo transfer head 15 with its transfer electrodes or transfer elements 16 is engaged. Source 19 may transmit visible or infrared light in order to reduce the energy required to be derived from the element 16 and necessary to dissolve particles 17 from the foil 14. Elements 17 are shown, greatly enlarged, in FIG. 2 at a circumferential region of cylinder 11 beyond the thermo transfer element.

A third radiation source 19 is directed to a circumferential region of the inner wall of the cylinder which is downstream or behind the imaging region and against which the thermo transfer head 15 is engaged. Depending on the type of oleophilic substance, radiation source 20 may be used to polymerize, cure or harden the particles 17. For example, source 20 can be used for polymerization of polymers or to burn-in transferred material. This accelerates the bonding process of the oleophilic particles. The radiation source 19 may emit infrared radiation, visible light, or actinic radiation, that is, radiation which is rich in ultraviolet (UV) wave lengths, suitable for example for crosslinking and curing polymers.

FIG. 2 illustrates a further and fourth radiation source 21 which can be selectively energized in order to erase information placed on the form cylinder, by removing particles 17. Selectively, it may also be used to further harden or cure particles which are intended to remain. Thus, radiation source 21 could emit infrared radiation to provide for liquefication and vaporization or direct sublimation of particles 17; it may, also selectively, cause merely softening of the particles 17 so that they can then be removed by a doctor blade 22, engaged against the cylinder.

Erasing of information on the form cylinder 11 is independent of the process used to provide the image on the cylinder. Thus, erasing of information on the form cylinder is substantially enhanced and speeded up by providing a radiation source within the interior of the cylinder. For example, the imaging on the cylinder 11 could be carried out by means of an ink jet recording head, ink being subsequently set by suitable supply of energy from source 21 or burned off by substantially higher supply of energy.

The respective radiation sources 18–21 may have reflectors or mirrors associated therewith in order to direct the radiation to desired wall regions of the cylinders 1, 11. Diaphragms or masks can additionally be used to provide for controlled bundling or directing of the radiation. Such masks may have slits, square or circular openings; mirrors can be used to direct the path of radiation. Additionally, externally placed radiation sources, or light reaching the outside from the interior of the inside, can be redirected towards selected surface regions by suitable mirrors or reflectors. The radiation can be directed to the entire surface of the cylinder, or only against parts thereof, for example to provide for partial erasing of printed information. Thus, cylinder 11 may, for example, carry both general announcement or advertising material as well as a news story. If the news story changes, or is up-dated for a later edition, only that much of the cylinder can be erased which contains the news story, the advertising material remaining thereon, by selective direction of the radiation only towards that part which contains the news story.

The energy applied to the surface of the cylinder, be it the inner or the outer surface, may also include electromagnetic radiation. The particular selected radiation will depend on the nature of the oleophilic substance and to which type of radiation it is sensitive to.

The form cylinders 1, 11 are preferably made of glass or glass ceramic, for example of the material known under the trade name Ceran. The surface should have a predetermined controlled roughness with an average roughness depth of $R_z$ of 2 to 10 micrometers, for example.

The cylinder surface may be made permanently hydrophilic, for example in edge zones where inking is never desired. Likewise, longitudinal strips or stripes may be left, extending circumferentially around the cylinder, which should be permanently hydrophilic. To provide such permanent hydrophilic zones or stripes, additives to a glass melt may be used; other arrangements are suitable, for example subsequent treatment by chemical or thermal diffusion, ion implantation, vapor deposition of a material generating a smooth surface, and the like.

Using a form cylinder of glass or glass ceramics has additional advantages, namely that the radiation can pass through the cylinder effectively without loss. Thus, the particles are heated primarily, whereas the cylinder wall—in contrast to pure heat application to a metallic cylinder from the outside—remains essentially cool. Glass and glass ceramic additionally have the advantage of low heat conductivity and thus less energy loss on the form cylinder itself. Glass or glass ceramic cylinders are stable because the thermal coefficient of expansion of the materials is small. The stability of dimension, and maintenance of size, with low tendency to form fissures due to internal stresses, is a further advantage. They are highly stable under various temperature conditions. This is particularly important if information transferred to the cylinder is to be erased under high temperature conditions, for example by vaporization or burning-off of previously applied substances.

The present invention is also suitable in a process in which the material being applied to the cylinder is not a single unitary substance but in which, first, a substance is applied in particles to the cylinder surface as, selectively, a bonding or a release layer for a subsequent oleophilic, or a hydrophilic substance. The first applied substance can be sublimated with the subsequently applied substance. The system of the present invention permits application of radiation directly on the sublimatable sub-layer or substance which, as noted, may be a bonding or, respectively, a release layer. This substantially simplifies decomposition of the sublimatable subtance, for example by infrared radiation to erase information applied on the form cylinder.

Various changes and modifications may be made within the scope of the inventive concept.

I claim:

1. A system for directly imaged printing, said system including a form cylinder (1, 11) for a printing machine, and means (4, 5, 6) for selectively transferring head meltable particles to the surface of said cylinder, wherein said cylinder comprises a hollow cylindrical wall of radiation transmissive material, defining within the hollow wall an inner space; and at least one radiation source (8; 18, 19, 20, 21) located in said inner space directing radiation at an inner surface of at least a portion of said cylindrical wall to assist in melting said heat meltable particles.

2. The system of claim 1, wherein the system wall comprises glass.

3. The system of claim 1, wherein the system wall comprises glass ceramic.

4. The system of claim 1, wherein the outer system surface is hydrophilic.

5. The system of claim 1, wherein a plurality of radiation sources (18, 19, 20, 21) are located in said inner space.

6. The system of claim 1, wherein at least one of the radiation sources (8; 18, 19, 20, 21) emits infrared radiation.

7. The system of claim 1, wherein at least one of the radiation sources (8; 18, 19, 20, 21) emits visible radiation.

8. The system of claim 1, wherein at least one of the radiation sources (8; 18, 19, 20, 21) emits actinic or ultraviolet radiation.

9. The system of claim 1, wherein at least one of the radiation sources (8; 18, 19, 29, 21) emits electromagnetic radiation.

10. The system of claim 1, wherein said means for selectively transferring heat meltable particles comprises a thermo recording transfer system (2–6) engageable against a predetermined surface portion of said cylinder (1, 11);

and wherein at least one of the radiation sources (8; 19) is directed against said predetermined surface portion.

11. The system of claim 1, wherein said means for selectively transferring heat meltable particles comprises a thermo recording transfer system (2–6) engagable against a predetermined surface portion of said cylinder (1, 11);

and wherein at least one of the radiation sources (20) is located, in the direction of rotation of the cylinder, downstream of or behind said predetermined surface portion.

12. The system of claim 1, wherein said means for selectively transferring heat meltable particles comprises a thermo recording transfer system (2–6) engageable against a predetermined surface portion of said cylinder (1, 11);

and wherein at least one of the radiation sources (20) is located, in the direction of rotation of the cylinder, leading or forwardly of said predetermined surface portion.

13. The system of claim 1, wherein said means for selectively transferring heat meltable particles comprises a thermo recording transfer system (2–6) engageable against a predetermined surface portion of said cylinder (1, 11);

and wherein at least one of the radiation sources (21) is directed to a region remote from said predetermined surface portion and emits energy at a level and of a characteristic to be suitable for at least assisting in erasing an image transferred by said thermo transfer system.

14. In a method of directly imaging a printing or form cylinder, a method of reducing energy required to selectively transfer heat meltable ink application controlling particles onto the outer surface of said printing or form cylinder, comprising applying heat to at least a portion of the wall region of said cylinder from the inside of said cylinder.

15. The method of claim 14, wherein said cylinder is hollow; and the step of applying heat to said portion of the cylinder comprises locating an energized radiation emitting energy source within the cylinder and directing the radiation from said source towards at least part of the wall portion of the cylinder.

16. The method of claim 15, wherein said step of directing the radiation comprises transmitting said radiation to the ink application controlling substances and through the cylinder without substantial absorption of said radiation within the cylinder by the material of the cylinder.

17. The method of claim 16, wherein said cylinder comprises at least one of: glass; glass ceramic; and said radiation comprises at least one of: infrared radiation; visible light; actinic or UV light; electromagnetic radiation.

18. The method of claim 14, wherein said cylinder comprises material highly transmissive to said radiation.

19. The method of claim 14, including the step of applying a sublimatable substance, in incremental particle form on the outer surface of said cylinder to form, respectively, a bonding or a release layer; and applying one of: oleophilic particles; hydrophilic particles, over the respective particles of the bonding or release layer.

20. The method of claim 14, wherein said ink application controlling substances are oleophilic substances.

* * * * *